US006325045B1

(12) United States Patent
Tokiya et al.

(10) Patent No.: US 6,325,045 B1
(45) Date of Patent: Dec. 4, 2001

(54) DEVICE FOR CONTROLLING INTAKE AIR QUANTITY OF COMBUSTION ENGINE AND A METHOD OF PRODUCING THE SAME

(75) Inventors: Satoru Tokiya; Mikihiko Suzuki, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/614,146

(22) Filed: Jul. 11, 2000

(30) Foreign Application Priority Data

Apr. 26, 2000 (JP) ..... 2000-125580

(51) Int. Cl.[7] ..... F02D 9/08

(52) U.S. Cl. ..... 123/399; 123/337; 29/890.127

(58) Field of Search ..... 123/337, 399, 123/403; 251/305; 29/890.12, 890.127

(56) References Cited

U.S. PATENT DOCUMENTS 5,490,487 * 2/1996 Kato et al. ..... 123/339
5,664,542 * 9/1997 Kanazawa et al. ..... 123/361
5,868,114 * 2/1999 Kamimura et al. ..... 123/399
5,979,405 * 11/1999 Sato et al. ..... 123/399
6,067,958 * 5/2000 Kamimura et al. ..... 123/337
6,098,594 * 8/2000 Kowatari et al. ..... 123/399
6,109,240 * 8/2000 Sato et al. ..... 123/399
6,155,533 * 12/2000 Semeyn et al. ..... 251/129.12
6,170,461 * 1/2001 Pursifull ..... 123/337
6,240,899 * 6/2001 Yamada et al. ..... 123/396

FOREIGN PATENT DOCUMENTS 6-65854 8/1994 (JP) ..... F02D/9/02
7-1016 1/1995 (JP) ..... F02D/9/02
11-108063 4/1999 (JP) ..... F02D/9/02
265861 * 9/2000 (JP) ..... F02D/9/10

* cited by examiner

*Primary Examiner*—Tony M. Argenbright
*Assistant Examiner*—Hai Huynh
(74) *Attorney, Agent, or Firm*—Sughrue, Mion, Zinn, Macpeak & Seas, PLLC

(57) ABSTRACT

In an intake air quantity controlling device for a combustion engine, a supporting portion of a bearing 10 for a valve shaft 9 having a choke valve 11, rotatably operated in an intake air passage 2, a supporting portion of a shaft of an intermediate gear 6, and a reference hole for a shaft of a rotor 12 fabricating a motor are formed in a metallic plate 15, whereby the intake air quantity controlling device has a high dimensional accuracy and a high strength.

3 Claims, 2 Drawing Sheets

DEVICE FOR CONTROLLING INTAKE AIR QUANTITY OF COMBUSTION ENGINE AND A METHOD OF PRODUCING THE SAME

BACKGROUND OF THE INVENTION

1. Field of the Invention

The present invention relates to a device for controlling an intake air quantity of a combustion engine, which controls the intake quantity in response to running conditions of a vehicle, and a method of producing the device.

2. Discussion of Background

A choke valve for a combustion engine of a vehicle is located in an intake passage of a throttle body, opened and closed in proportional to an amount of operating an accelerator, and operated upon, for example, detection of slipping by a difference between rotations of front wheels and rear wheels to control an output from the combustion engine by controlling an intake air quantity. Therefore, the choke valve is not directly connected to the accelerator by a linkage mechanism in order to open and close the choke valve. The choke valve is driven with a control of opening and closing positions by a motor and so on, and the opening and closing positions are determined by a composite signal including the signal concerning an amount of applying the accelerator.

FIG. 2 is a cross-sectional view of a part of a conventional intake quantity controlling device for a combustion engine. In FIG. 2, numerical reference 21 designates a housing of a throttle body, having an intake air controlling portion 23, having a diameter the same as that of an intake air passage 22 for supplying an intake air to the combustion engine, and a motor accommodating portion 25, both monolithically molded by same synthetic resins. Numerical reference 26 designates a valve shaft located in the intake air controlling portion 23 of the housing 21, supported by a bearing 27 at both ends so as to be rotatable, penetrating through the intake air passage 22, and having a choke valve 28. The choke valve 28 rotates and moves from a completely closed position to a fully opened position of the intake air passage 22 upon rotation of the valve shaft 26 so as to control an intake air quantity. To one end of the valve shaft 26, a decelerating mechanism driven by the motor 29 is coupled.

A stator 30 of the motor 29 is attached to the motor accommodating portion 25 of the housing 21 by inserting and molding. A rotator 32 has a driving shaft 31. Both ends of the driving shaft 31 are supported by bearings 33 and 34, located in the motor accommodating portion 25 of the housing. The driving shaft 31 is arranged in parallel with the valve shaft 26 and has a gear 31*a* at its tip.

Numerical reference 35 designates a decelerating gear comprising the decelerating mechanism. The decelerating gear decelerates rotation of the motor 29 in collaboration with other gears (not shown) to drive the valve shaft 26. Numerical reference 36 designates a sensor located in the vicinity of the coupled portion of the decelerating mechanism to the valve shaft 26. The sensor 36 detects a rotational angle of the valve shaft 26 in order to control a driving position of the motor 29. Numerical reference 37 designates a connector, monolithically molded with the housing 21 and integrally grouped so as to be externally connected with the sensor 36 and the motor 29. Numerical reference 38 designates a cover covering a driving portion of the valve shaft 26 between the valve shaft and the motor 29.

Since the conventional intake air quantity controlling device is constructed as described above, when the housing is made of a resin, a size of the housing is changed by a physical volume change by a temperature change after molding. Further, because of a difference of a rate of dimensional change with respect to a flowing direction at time of molding, there is a problem that a high technique and a management are necessary to enable a production achieving required stable accuracies of an inner diameter of the intake air passage, pitches of the decelerating portion, and so on. Further, because a strength of a resin is generally smaller than a strength of a metal, there is a problem that a specific shape is necessary to reinforce the strength.

SUMMARY OF THE INVENTION

It is an object of the present invention to solve the above-mentioned problems inherent in the conventional technique and to provide an intake air quantity controlling device for a combustion engine, which has a high dimensional accuracy and a high strength.

According to a first aspect of the present invention, there is provided an intake air quantity controlling device for a combustion engine comprising:

- a housing having an intake air passage of the combustion engine inside thereof;
- a valve shaft, positioned in the intake air passage so as to be rotatable;
- a choke valve, attached to the valve shaft and controlling an airflow rate through the intake air passage; and
- a motor, fixed to the housing and driving the valve shaft through a decelerating mechanism,
- wherein a supporting portion of a bearing for the valve shaft, an supporting portion for an intermediate gear shaft, and a reference hole for a rotor shaft of the motor are formed in a metallic plate.

According to a second aspect of the present invention, there is provided the intake air quantity controlling device for the combustion engine,

- wherein the intake air passage, a motor accommodating portion, and a casing are monolithically molded.

According to a third aspect of the present invention, there is provided a method of producing the intake air quantity controlling device for the combustion engine,

- wherein the reference hole of the rotor shaft, an inner diameter of a stator, and a penetrating hole through the plate are coaxially arranged by a metal mold for molding a resin.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
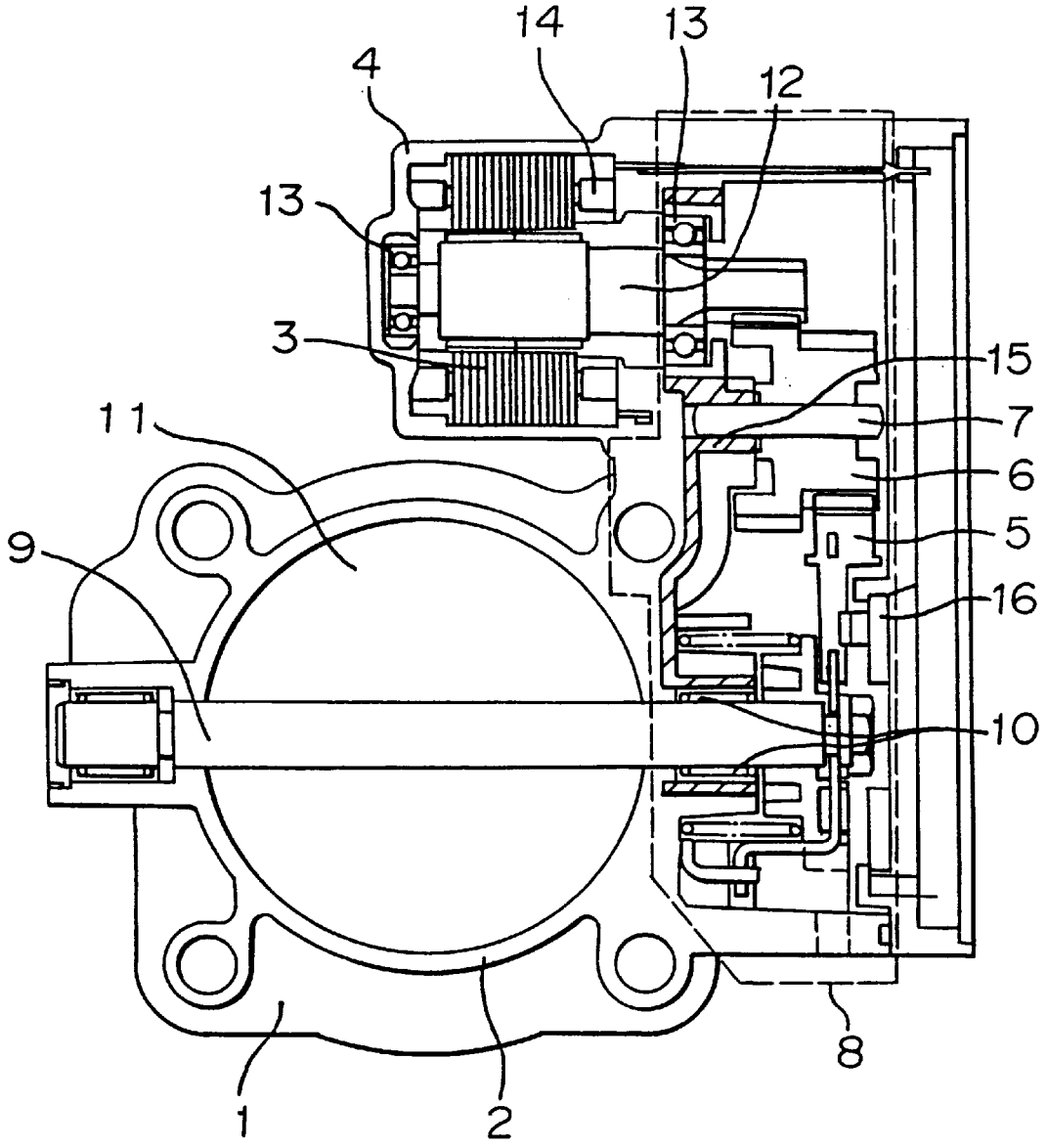
FIG. 1 is a cross-sectional view of part of a structure of an intake air quantity controlling device for a combustion engine according to Embodiment 1 of the present invention.
Figure 2:
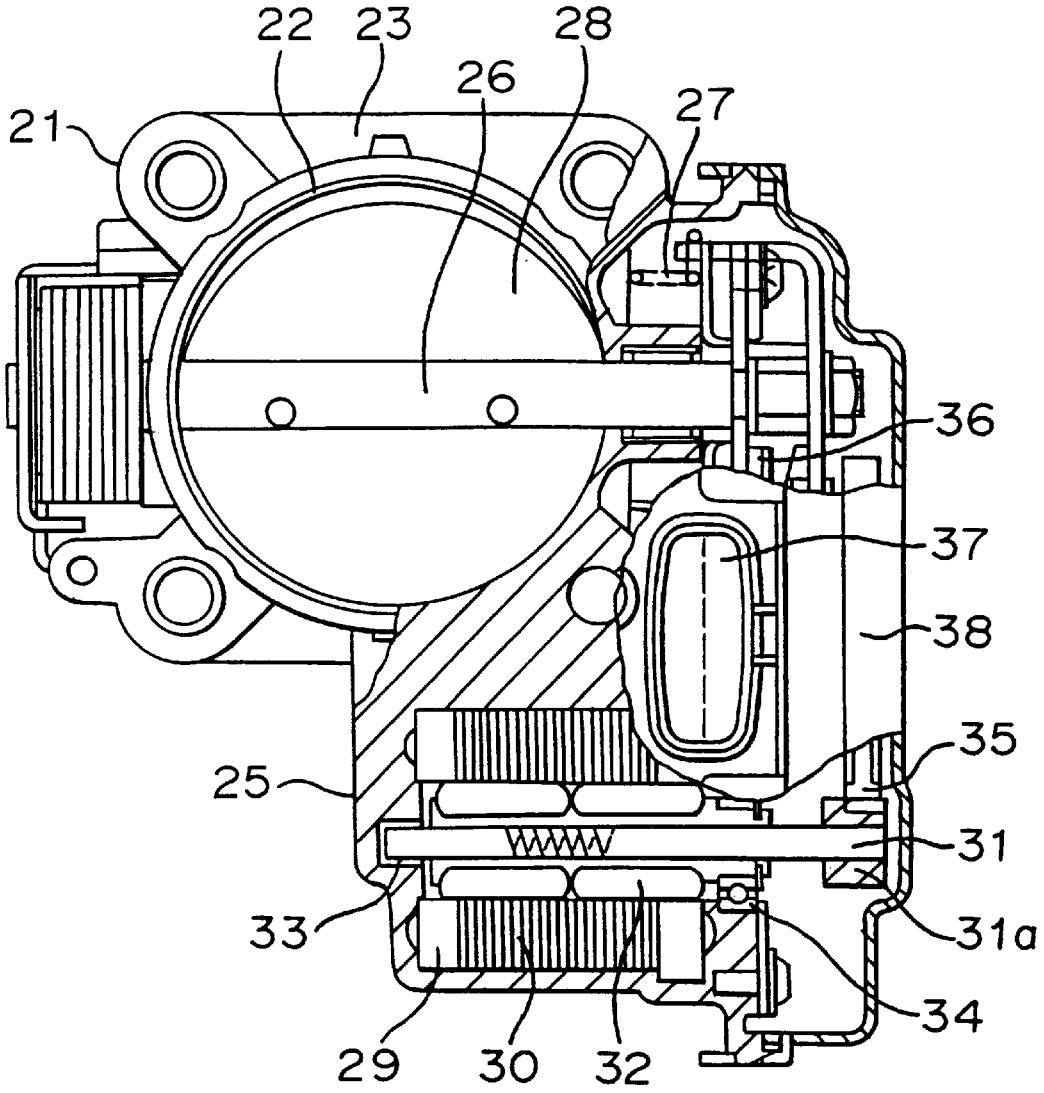
FIG. 2 PRIOR ART
FIG. 2 is a cross-sectional view of a part of a structure of a conventional intake air quantity controlling device for a combustion engine.

A detailed explanation will be given of the preferred embodiment of the present invention in reference to FIG. 1 as follows, wherein the same numerical reference are used for the same or similar portion and description of these portions is omitted.

EMBODIMENT 1

Hereinbelow, Embodiment 1 will be described in reference of FIG. 1. FIG. 1 is a cross-sectional view of a part of an intake air quantity controlling device for a combustion engine according to Embodiment 1 of the present invention. In FIG. 1, numerical reference 1 designates a housing of a throttle body, in which an intake air passage 2 supplying an intake air to the combustion engine, a motor accommodating portion 4 accommodating a stator 3, a gear 5, and an intermediate gear 6 are accommodated. The housing and a casing 8 for holding a pin 7 are monolithically molded by same synthetic resins. However, in order to avoid an excessive deformation of an inner diameter of the intake air passage 2, caused after molding, a shape aiming reinforcement of a strength, such that a motor and an intake valve are directly molded by same synthetic resins, is not provided.

Since a material of the intake air passage 2 is the synthetic resin, and the synthetic resin deforms by contraction at time of molding t o deteriorate a requisite circularity of the inner diameter, it is possible to assure an accuracy of the requisite circularity by a correction such that a mold itself is previously modified. For example, the correction is application of an elliptic shape in expectation of deformation. Both ends of the valve shaft 9 is supported by a bearing 10, located in the intake air passage 2 of the housing 1, so as to be freely rotatable. The valve shaft penetrates through the intake air passage 2, and has a choke valve 11. The choke valve 11 controls the intake air quantity by rotating from a completely closed position to a fully opened position upon rotation of the valve shaft 9. To one end of the valve shaft 9, the gear 5 is fixed. The intermediate gear 6, engaged with the gear 5, is engaged with a rotor 12.

Both ends of the rotor 12 are supported by bearings 13, located in the motor accommodating portion 4 of the housing 1 in parallel with the valve shaft 9. By applying a current through a coil 14 of the stator 3 using a control circuit (not shown), the rotor 12 is driven. In the decelerating mechanism, an accuracy of a distance between the bearing 10 and the pin 7 and an accuracy of a distance between the pin 7 and a shaft of the rotor 12 are important. By inserting a metallic plate 15 in the housing 1 and molding the housing 1 and the metallic plate 15, it is possible to suppress the deformation after molding, and the decelerating mechanism can be formed with a high accuracy.

A reference hole of the rotor 12 and an inner diameter of the stator 3 are coaxially arranged. A penetrating hole is formed in the plate 15 coaxially with the inner diameter of the stator 3. An accuracy is assured by coaxially arranging using a metal mold for molding resin. Numerical reference 16 designates a sensor, located in a vicinity of a coupling portion between the valve shaft 9 and the decelerating mechanism, for controlling a phase of the rotor 12 by detecting a rotational angle of the valve shaft 9.

In thus constructed intake air quantity controlling device for the combustion engine according to Embodiment 1 of the present invention, there is an advantage that the housing 1, which does not require a strength for attaching the motor because the stator 3 of the motor is inserted into and monolithically molded, with the housing, the housing is formed by the synthetic resin. Therefore, the number of components is reduced, and the intake air quantity controlling device has a light weight. Further, because the rotor 12 and the valve shaft 9 are arranged in parallel, and the sensor 16 is accommodated in the vicinity of the coupling portion between the valve shaft 9 and the decelerating mechanism, it is possible to shorten a dimension in an axial direction, and the intake air quantity controlling device can be properly mounted on the combustion engine.

The first advantage of the intake air quantity controlling device for the combustion engine according to the present invention is that deformation after molding can be suppressed to obtain a high accuracy.

The second advantage of the intake air quantity controlling device according to the present invention is that a high dimensional accuracy and a high strength are obtainable.

The third advantage of the method of producing the intake air quantity controlling device for combustion engine according to the present invention is that the device can be assembled with a high accuracy.

Obviously, numerous modifications and variations of the present invention are possible in light of the above teachings. It is therefore to be understood that within the scope of the appended claims, the invention may be practiced otherwise than as specifically described herein.

The entire disclosure of Japanese Patent Application JP2000-125580 filed on Apr. 26, 2000 including specification, claims, drawings and summary are incorporated herein by reference in its entirety.

What is claimed is:

1. An intake air quantity controlling device for a combustion engine comprising:

a housing having an intake air passage of the combustion engine inside thereof;

a valve shaft, positioned in the intake air passage so as to be rotatable;

a choke valve, attached to the valve shaft, for controlling an airflow rate through the intake air passage; and a motor, fixed to the housing and driving the valve shaft through a decelerating mechanism, wherein a supporting portion of a bearing for the valve shaft, an supporting portion for an intermediate gear shaft, and a reference hole for a rotor shaft of the motor are formed in a metallic plate.

2. The intake air quantity controlling device for the combustion engine according to claim 1, wherein the intake air passage, a motor accommodating portion, and a casing are monolithically molded.

3. A method of producing the intake air quantity controlling device for a combustion engine according to claim 1, wherein the reference hole of the rotor shaft, an inner diameter of a stator, and a penetrating hole through the plate are coaxially arranged by a metal mold for molding a resin.

* * * * *